United States Patent [19]

Suzuki et al.

[11] 4,361,617

[45] Nov. 30, 1982

[54] HOLLOW WATER-ABSORBING POLYESTER FILAMENTS AND A PROCESS FOR PRODUCING THE SAME

[75] Inventors: Togi Suzuki; Kiyokazu Tsunawaki, both of Matsuyama; Osamu Wada, Takatsuki; Akio Kimura, Ashiya, all of Japan

[73] Assignee: Teijin Limited, Osaka, Japan

[21] Appl. No.: 171,335

[22] Filed: Jul. 23, 1980

[30] Foreign Application Priority Data

Jul. 26, 1979 [JP] Japan ..... 54-94189
Sep. 11, 1979 [JP] Japan ..... 54-115730

[51] Int. Cl.[3] ..... D03D 3/00

[52] U.S. Cl. ..... 428/224; 264/41; 264/49; 264/293; 264/344; 428/253; 428/365; 428/369; 428/373; 428/395; 428/397; 428/398; 428/400; 428/480; 428/913

[58] Field of Search ..... 428/220, 224, 253, 365, 428/369, 373, 395, 397, 398, 913, 252, 400, 480; 264/49, 41, 293, 344

[56] References Cited

U.S. PATENT DOCUMENTS

| | | | |
|---|---|---|---|
| 3,558,420 | 1/1971 | Opfell | 428/398 |
| 3,682,846 | 8/1972 | Samo et al. | 264/49 |
| 3,957,936 | 5/1976 | Lauchenauer | 428/398 |
| 4,164,603 | 8/1979 | Siggel et al. | 428/398 |
| 4,234,431 | 11/1980 | Mishiro | 264/49 |
| 4,254,182 | 3/1981 | Yamaguchi et al. | 264/49 |

*Primary Examiner*—James J. Bell
*Attorney, Agent, or Firm*—Burgess, Ryan and Wayne

[57] ABSTRACT

Hollow water-absorbing polyester filaments each having a number of fine caves which are evenly distributed in at least a portion of the filament and through which the hollow is connected to the outside of the filament, are produced (1) by preparing hollow filaments from a blend of a principal polyester component and a cave-forming agent consisting of at least one member selected from:

(i) copolyesters containing an additional divalent organic sulfonic acid compound moiety of the formula (II):

(II)

wherein Z is a trivalent aromatic or aliphatic hydrocarbon radical, $M^1$ is H or metal atom, $R^1$ is an ester-forming organic radical and $R^2$ is an H atom or ester-forming organic radical;

(ii) phosphorus compounds of the formula (III):

(III)

wherein $R^3$ is a monovalent organic radical, X is $—OR^4$, wherein $R^4$ is an H atom or a monovalent organic radical, $—OM^3$, wherein $M^3$ is a metal atom, or a monovalent organic radical, $M^2$ is a metal atom and m=0 or 1, and;

(iii) aromatic carboxy-sulfonic acid compounds of the formula (IV):

(IV)

wherein Y is an H atom or ester-forming organic radical, $M^4$ and $M^5$ each are a metal atom, respectively, and n=1 or 2, and (2) by removing the at least a portion of cave-forming agent and a portion of the principal polyester component from the resultant hollow filaments so as to form numerous concaves on the peripheral and hollow surfaces, numerous pores in the body of the filament, and numerous channels through which the pores are connected to each other and to the concaves, the concaves and pores having a longitudinal size of 50 times or less the lateral size thereof, which is 0.01 to 3 microns.

28 Claims, 5 Drawing Figures

X 3000

X 3000

X 3000

X 3000

X 3000

X 3000

HOLLOW WATER-ABSORBING POLYESTER FILAMENTS AND A PROCESS FOR PRODUCING THE SAME

FIELD OF THE INVENTION

The present invention relates to hollow water-absorbing polyester filaments and a process for producing the same. More particularly, the present invention relates to hollow polyester filaments each containing a number of caves through which the hollow is connected to the outside of the filament and each exhibiting an excellent water and moisture absorbing property, and also relates to a process for producing the same.

BACKGROUND OF THE INVENTION

Polyesters such as polyalkylene terephthalates are widely usable in various resin industries due to their excellent physical and chemical properties. Especially, the polyester is highly useful for producing synthetic filaments or fibers which are also useful in various fields. However, since the polyester per se is highly hydrophobic, the polyester filaments are also hydrophobic and not at all suitable for use as filaments exhibiting a water and moisture absorbing property.

In order to obtain polyester filaments exhibiting a hydrophilic property, attempts were made to modify the known polyester filaments by producing them from a blend of a polyester with a polyalkylene glycol (U.S. Pat. No. 3,329,557 and British Pat. No. 956,833) or from a mixture of a polyalkylene glycol with an organic sulfonic metal salt (U.S. Pat. No. 3,682,846). However, the hydrophilic property of such resultant polyester filaments was found to be not only unsatisfactory but also readily degraded when the polyester filaments were laundered. In addition, the above-mentioned modification was found to cause the resultant polyester filaments to exhibit decreased physical properties, especially decreased resistance to actinic rays and a decreased thermal resistance.

In another attempt to obtain polyester filaments exhibiting a hydrophilic property, polyester filaments containing polyalkylene glycol or a mixture of polyalkylene glycol and organic sulfonic metal salt were treated with an alkali aqueous solution. This treatment resulted in formation of a number of fine concaves (long grooves) in the peripheral surface of the individual filament, the concaves extending approximately in parallel to the longitudinal axis of the filament and being effective for enhancing the water and moisture absorbing property of the filament. However, the resultant treated filament exhibited an extremely poor tensile strength, so that the filament could not be practically used.

In a recent attempt to obtain polyester filaments exhibiting a hydrophilic property, which was carried out by some of the inventors of the present invention, a hollow polyester filament containing an organic sulfonic metal salt which was not reactive to the polyester was treated with an alkali aqueous solution, so as to remove at least a portion of the organic sulfonic metal salt. This treatment resulted in formation of caves through which the hollow was connected to the outside of the filament. The resultant hollow filament had a satisfactory water and moisture absorbing property, and tensile strength. However, it was found that this type of the hollow filament exhibited a poor resistance to fibrillation when the filament was rubbed. This is because the caves were composed of long outside concaves formed in the peripheral surface of the filament, long pores formed the body of the filament and long inside concaves formed in the hollow surface of the filament, and; the outside and inside concaves and the pores extended in parallel to the longitudinal axis of the filament, and had a longitudinal size of 200 times or more the lateral size thereof. The long outside and inside concaves and the long pores promoted the fibrillation of the filament.

Under the above-mentioned circumstances, it is strongly desired to provide a polyester filament which has not only an excellent water and moisture absorbing property, but also, a satisfactory resistance to fibrillation of the filament.

SUMMARY OF THE INVENTION

The object of the present invention is to provide a hollow polyester filament having an excellent long-lasting water and moisture absorbing property, and a satisfactory resistance to fibrillation, and to provide a process for producing such filament which does not degrade the other physical properties of the filaments.

The above-mentioned object can be attained by the hollow polyester filament of the present invention which has at least one hollow extending in parallel to the longitudinal axis of said filament, and a number of caves distributed in at least a portion of the body of the filament and consisting of a number of fine outside concaves formed in the peripheral surface of the filament, a number of fine pores formed within the body of the filament, a number of fine inside concaves formed in the hollow surface of the filament, and a number of fine channels through which the pores are connected to each other, and to the outside concaves and inside concaves, the outside and inside concaves and the pores extending approximately in parallel to the longitudinal axis of the filament, which filament is characterized in that each of the outside and inside concaves and said pores has a longitudinal size of at the largest 50 times the lateral size thereof, which is in a range of from 0.01 to 3 microns.

The above-mentioned hollow water-absorbing polyester filament can be prepared by the process of the present invention which comprises the steps of (A) preparing hollow polyester filaments each having at least one hollow extending in parallel to the longitudinal axis of the filament, from a blend of (a) a principal polyester component which comprises an acid moiety consisting of at least one aromatic dicarboxylic acid or its ester-forming derivative and a glycol moiety consisting of at least one alkylene glycol having 2 to 6 carbon atoms or its ester-forming derivative, with (b) a cave-forming agent, and;

(B) removing at least a portion of the cave-forming agent and a portion of the principal polyester component from the resultant hollow polyester filaments by treating them with an alkali aqueous solution to cause each of the hollow polyester filaments to be provided with a number of caves distributed in at least a portion of the body of each filament, and consisting of a number of fine outside concaves formed in the peripheral surface thereof, a number of fine pores formed within the body thereof, a number of fine inside concaves formed in the hollow surface thereof, and a number of fine channels through which the pores are connected to each other and to the outside concaves and said inside concaves, the outside and inside concaves and the pores extending approximately in parallel to the longitudinal axis of each filament, which process is characterized in that (1) the cave-forming agent consists of at least one member selected from the group consisting of (i) copolyesters which comprises a glycol compound moiety, an aromatic dicarboxylic acid compound moiety and an additional divalent organic sulfonic acid compound moiety of the formula (II):

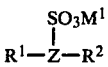

(II)

wherein Z represents a member selected from the group consisting of trivalent aromatic hydrocarbon radicals and trivalent aliphatic hydrocarbon radicals; $M^1$ represents a member selected from the group consisting of hydrogen and metal atoms; $R^1$ represents an ester-forming organic radical and $R^2$ represents a member selected from the group consisting of a hydrogen atom and ester-forming organic radicals;

(ii) phosphorus compounds of the formula (III):

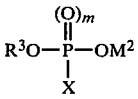

(III)

wherein $R^3$ represents a monovalent organic radical, X represents a member selected from the group consisting of $—OR^4$, wherein $R^4$ represents a hydrogen atom or a monovalent organic radical, $—OM^3$, wherein $M^3$ represents a metal atom, and a monovalent organic radical, $M^2$ represents a metal atom and m represents zero or 1, and;

(iii) aromatic carboxy-sulfonic acid compounds of the formula (IV):

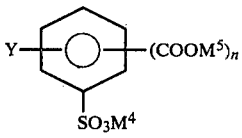

(IV)

wherein Y represents a member selected from the group consisting of a hydrogen atom and ester-forming organic radical, $M^4$ represents a metal atom, $M^5$ represents a metal atom and n represents an integer of 1 or 2, and; (2) each of the outside and inside concaves and the pores has a longitudinal size of at the largest 50 times the lateral size thereof, which is in a range of from 0.01 to 3 microns.

DETAILED DESCRIPTION OF THE INVENTION

Figure 1:
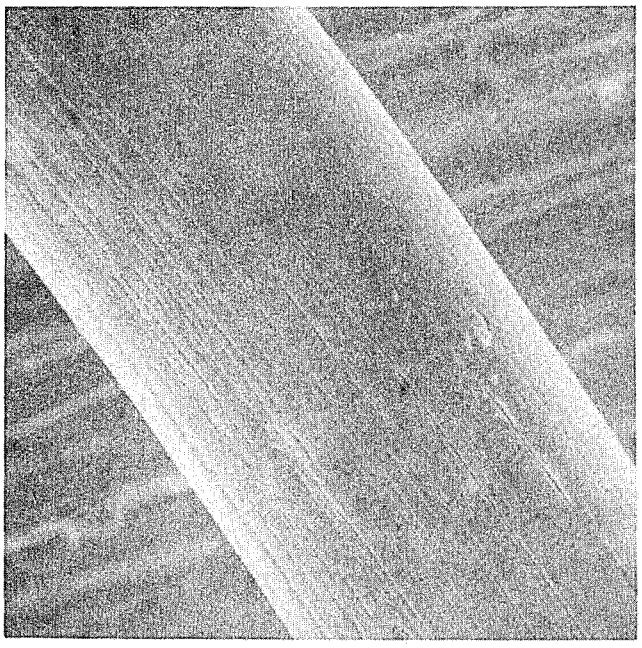
FIG. 1 is an electron microscope view of a peripheral surface of a hollow water-absorbing polyester filament different from that of the present invention at a magnification of 3000.

Referring to FIG. 1, the peripheral surface of the different hollow water-absorbing polyester filament from that of the present invention has a number of long outside concaves each having a small width (lateral size) of from 0.1 to 0.4 microns and an extremely large length (longitudinal size) corresponding to 200 times or more the width. It is apparent that each of the inside concaves formed in the hollow surface of the conventional hollow filament and the pores formed within the inside of the conventional hollow filament has the same configuration, the same small lateral size and the same extremely large longitudinal size as those of the outside concaves mentioned above. The above-mentioned configuration of the outside and inside concaves and pores causes the conventional hollow filament to exhibit a poor resistance to fibrillation.

Figure 2:
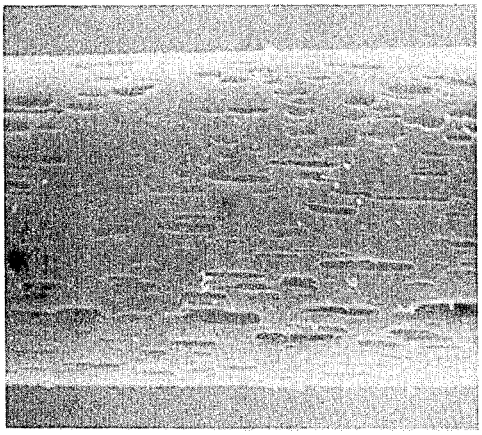
FIGS. 2, 3A, and 4 are respectively an electron microscope view of a peripheral surface of the hollow water-absorbing polyester filament in an embodiment of the present invention at a magnification of 3000.

In the hollow filament of the present invention, it is important that the lateral size of the outside concaves, inside concaves and pores be in a range of from 0.01 to 3 microns, preferably, 0.1 to 3 microns, and that their longitudinal size correspond to at the largest 50 times, preferably, 20 times, the above-mentioned lateral size. For example, referring to FIG. 2, in an embodiment of the present invention, the peripheral surface of the hollow filaments is provided with a number of outside concaves each having a width (lateral size) of from 0.1 to 1 micron and a length (longitudinal size) corresponding to, at the largest, 20 times the width. The configuration of the outside concaves in FIG. 2 is obviously different from that in FIG. 1. Also, the specific configuration of the outside and inside concaves and pores of the hollow filament of the present invention causes the hollow filament to exhibit not only an excellent water and moisture absorbing property, but also, a satisfactory resistance to the fibrillation.

If the lateral size of the outside and inside concaves and the pores is less than 0.01 microns, the resultant hollow filament exhibits an unsatisfactory water and moisture absorbing property. Also, if the lateral size of the outside and inside concaves and the pores is more than 3 microns, the resultant hollow filament exhibits an undesirably poor tensile strength. Furthermore, if the longitudinal size of the outside and inside concaves and the pores corresponds to more than 50 times the lateral size thereof, the resultant hollow filament exhibits an undesirably poor resistance to fibrillation.

The hollow polyester filament of the present invention may be provided with one or more hollows which extend along the longitudinal axis of the filament and which are independent from each other. However, it is preferable that a single hollow be located in the center portion of the filament.

Also, so that the hollow filament will exhibit a satisfactory water absorbing property, mechanical strength and resistance to crush, it is preferable that the entire cross-sectional area of the hollow or hollows in the filament correspond to 5 to 50%, more preferably, 10 to 30%, of the entire cross-sectional area of the filament including the hollow or hollows.

In the hollow filament of the present invention, it is preferable that the total sum of the cross-sectional areas of the outside and inside concaves and the pores correspond to 2 to 50%, more preferably, 5 to 30%, of the cross-sectional area of the filament excluding the hollow.

Also, it is preferable that the total sum of the opening areas of the outside concaves correspond to 2 to 50%, more preferably, 5 to 50%, of the entire peripheral surface of the filament. The percentage of the total sum of the opening areas of the outside concaves can be determined by a method as described hereinafter.

The cross-sectional profile of the hollow filament of the present invention is not limited to a specific configuration. That is, both the cross-sectional profiles of the periphery filament and the hollow therein may be circular or either one of the cross-sectional profiles of the filament and the hollow therein may be circular and the other not circular. Furthermore, both the cross-sectional profiles of the filament and the hollow therein may be not circular. In this case, the non-circular cross-sectional profile of the filament may be either similar to or different from that of the hollow.

The denier of the hollow filament of the present invention is not restricted to a specific range of value. However, it is preferable that the hollow filament have a denier of 10 or less (a dtex of 11.1 or less). Also, it is preferable that the hollow filament of the present invention exhibit a tensile strength of 2.0 g/d or more.

The hollow polyester filament of the present invention is provided with a number of caves distributed throughout at least a portion of the body of the filament. The caves consist of a number of fine outside concaves, inside concaves, pores and channels through which the pores are connected to each other, and to the outside and inside concaves. Therefore, the hollow can be connected to the outside of the filament through the caves. Also, the caves cause the hollow filament to have an extremely large internal surface, which is effective for enhancing the water and moisture absorbing property of the filament. Preferably, the hollow polyester filament of the present invention has a water absorbing rate of at least 120 seconds per 0.04 ml of water, which is determined by a method to be explained hereinafter. Also, it is preferable that the hollow polyester filament of the present invention have an absorption of at least 50%, which is determined by another method as described hereinafter. Furthermore, it is preferable that the hollow polyester filament of the present invention exhibit a degree of fibrillation of 10% or less, more preferably, 5% or less, which is determined by still another method as described hereinafter.

The hollow filament of the present invention preferably consist essentially of a polyester having at least 90% by molar amount of recurring units of the formula (I):

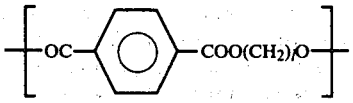

(I)

wherein l represents an integer of 2 to 6. That is, the recurring units of the formula (I) consists of a terephthalic acid moiety and an alkylene glycol moiety containing 2 to 6 carbon atoms. The alkylene glycol may be selected from ethylene glycol, trimethylene glycol, tetramethylene glycol, pentamethylene glycol and hexamethylene glycol. The preferable alkylene glycol is either ethylene glycol or tetramethylene glycol. That is, it is preferable that the polyester be either polyethylene terephthalate or polybutylene terephthalate.

The polyester usable for the present invention may contain at least one di-functional carboxylic acid moiety as an additional moiety to the terephthalic acid moiety. The di-functional carboxylic acid may be derived from the compound selected from aromatic carboxylic acids such as isophthalic acid, naphthalene di-carboxylic acid, diphenyldicarboxylic acid, diphenoxyethane dicarboxylic acid, β-hydroxyethoxy benzoic acid and p-hydroxybenzoic acid; aliphatic carboxylic acids such as sebacic acid, adipic acid and oxalic acid; and cycloaliphatic dicarboxylic acids such as 1,4-cyclohexane dicarboxylic acid.

The polyester usable for the present invention may contain at least one diol moiety as additional moiety to the alkylene glycol moiety. The doil moiety may be derived from aliphatic, cycloaliphatic and aromatic diol compounds such as cyclohexane-1,-4-dimethanol, neopentyl glycol, polyethylene glycol, bisphenol A and bisphenol S.

The hollow polyester filaments of the present invention can contain any conventional additives, for example, catalyst, anti-discoloring agent, thermostabilizing agent, optical brightening agent, flame-retarding agent, delusterant; dye; pigment and other inert additives, insofar as such additives do not cause the water absorbing property of the filaments to be decreased.

The hollow polyester filament of the present invention can be produced by a process which comprises the steps of:

(A) preparing hollow polyester filaments, each having at least one hollow extending in parallel to the longitudinal axis of the filament, from a blend of:

(a) a principal polyester component which comprises an acid moiety consisting of at least one aromatic dicarboxylic acid or its ester-forming derivative and a glycol moiety consisting of at least one alkylene glycol having 2 to 6 carbon atoms or its ester-forming derivative, with (b) a cave-forming agent, and;

(B) removing at least a portion of the cave-forming agent and a portion of the principal polyester component from the resultant hollow polyester filaments by treating them with an alkali aqueous solution to cause each of the hollow polyester filaments to be provided with a number of caves distributed in at least a portion of the body of each filament, and consisting of a number of fine outside concaves formed in the peripheral surface thereof, a number of fine pores formed within the body thereof, a number of fine inside concaves formed in the hollow surface thereof, and a number of fine channels through which said pores are connected to each other and to the outside concaves and said inside concaves, the outside and inside concaves and said pores extending approximately in parallel to the longitudinal axis of each filament, preferably, the principal polyester component consist essentially of a polyester having at least 90% by molar amount of recurring units of the formula (I):

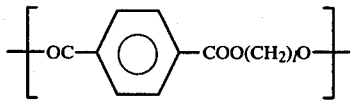

(I)

wherein represents an integer of 2 to 6. That is, the recurring units of the formula (I) consists of a terephthalic acid moiety and an alkylene glycol moiety containing 2 to 6 carbon atoms. The alkylene glycol may be selected from ethylene glycol, trimethylene glycol, tetramethylene glycol, pentamethylene glycol and hexamethylene glycol. The preferable alkylene glycol is either ethylene glycol or tetramethylene glycol. That is, it is preferable that the principle polyester component be either polyethylene terephthalate or polybutylene terephthalate.

The principal polyester component usable for the process of the present invention may contain at least one di-functional carboxylic acid moiety as an additional moiety to the terephthalic acid moiety. The di-functional carboxylic acid may be derived from a compound selected from aromatic carboxylic acids, such as isophthalic acid, napthalene di-carboxylic acid, diphenyldicarboxylic acid, diphenoxyethane dicarboxylic acid, β-hydroxyethoxy benzoic acid and p-hydroxybenzoic acid; aliphatic carboxylic acids, such as sebacic acid, adipic acid and oxalic acid, and; cycloaliphatic dicarboxylic acids, such as 1,4-cyclohexane dicarboxylic acid.

The principal polyester component usable for the process of the present invention may contain at least one diol moiety as additional moiety to the alkylene glycol moiety. The diol moiety may be derived from aliphatic, cycloaliphatic and aromatic diol.

The principal polyester component usable for the process of the present invention can be prepared by any conventional process. For example, in the case of polyethylene terephthalate, a terephthalic ethylene glycol ester or a lower polymerization product thereof is prepared by directly esterifying the terephthalic acid with ethylene glycol, or by ester-exchanging a lower alkyl ester of terephthalic acid, for example, dimethyl terephthalate, with ethylene glycol, or by reacting terephthalic acid with ethyleneoxide. Then, the ester or the lower polymerization product is condensed under a reduced pressure at an elevated temperature to provide the polyethylene terephthalate having a desired degree of polymerization.

The cave-forming agent consists of at least one member selected from the group consisting of:

(i) the copolyesters containing the additional divalent organic sulfonic acid compound moiety of the formula (II);

(ii) the phosphorus compounds of the formula (III), and;

(iii) the aromatic carboxy-sulfonic acid compounds of the formula (V).

In the step (A) of the process of the present invention, the hollow filament can be prepared by melt-spinning a blend of the principal polyester component and the cave-forming agent through a hollow filament spinning device. Usually, the melt-spinning procedure is followed by a drawing, heat-treating and, optionally, texturing, bulking or twisting procedures. Thereafter, the removing procedure (B) is applied to the hollow filament.

In another method, the hollow filament may be prepared in such a manner that core-in-sheath type composite filaments, in each of which the sheath constituent consists of a blend of the principal polyester component and the cave-forming agent, and the core constituent consists of a polymeric material having a higher degree of alkali solubility than that of the sheath constituent, are prepared by using a core-in-sheath composite filament melt-spinning device. The core-in-sheath type composite filaments are drawn, heat-treated and, optionally, textured, bulked, twisted, woven or knitted, and the resultant textile material is subjected to the removing procedure (B). This method is effective for avoiding undesirable flattening of the hollow filaments during the various processes, especially, the texturing and twisting procedures.

The copolyester (i) comprises a glycol compound moiety, an aromatic dicarboxylic acid compound moiety and an additional divalent organic sulfonic acid compound moiety of the formula (II):

$$R^1-\underset{\displaystyle SO_3M^1}{\underset{|}{Z}}-R^2 \qquad \text{(II)}$$

wherein Z represents a member selected from the group consisting of trivalent aromatic hydrocarbon radicals and trivalent aliphatic hydrocarbon radicals; $M^1$ represents a member selected from the group consisting of hydrogen and metal atoms; $R^1$ represents an ester-forming organic radical, and; $R^2$ represents a member selected from the group consisting of a hydrogen atom and ester-forming organic radicals. In the copolyester (i), the glycol moiety and the aromatic dicarboxylic acid moiety may respectively be selected from the same group as that for the principal polyester component.

In the additional divalent organic sulfonic acid moiety of the formula (II), each of the ester-forming organic radicals represented by $R^1$ and $R^2$ may be selected from the group consisting of $$-O-\underset{\displaystyle O}{\underset{\|}{C}}-R,\ -\underset{\displaystyle O}{\underset{\|}{C}}-OH,\ -\underset{\displaystyle O}{\underset{\|}{C}}-OR,$$

$$-(CH_2)_{n'}-OH,\ -O(CH_2)_{n''}-[O(CH_2)_{n''}]_{m'}-OH \text{ and}$$

$$-\underset{\displaystyle O}{\underset{\|}{C}}-[O(CH_2)_{n''}]_{m'}-OH$$

wherein R represents a member selected from the group consisting of lower alkyl radicals having 1 to 10 carbon atoms, n'' represents an integer of 2 or more, and n' and m' represents an integer of 1 or more, respectively. Also, in the formula (II), the metal atom represented by $M^1$ may be selected from alkali metals.

The additional divalent organic sulfonic acid moiety of the formula (II) may be selected from the group consisting of sodium 3,5-di(carbomethoxy)benzene sulfonate and potassium 3,5-di(carbomethoxy) benzene sulfonate, sodium 1,5-di(carbomethoxy) naphthalene-3-sulfonate and potassium 1,5-di(carbomethoxy) naphthalene-3-sulfonate, and sodium 2,5-bis(hydroxyethoxy) benzene sulfonate and potassium 2,5-bis(hydroxyethoxy) benzene sulfonate. In the preparation of the copolyester (i), the additional divalent organic sulfonic acid moiety is added into a polymerization mixture containing the acid moiety and the glycol moiety before the start of the copolymerization or at any stage from the start to the end of the copolymerization process. Preferably, it is added before the ester formation reaction or lower polymerization reaction of the acid moiety with the glycol moiety is completed. The additional divalent organic sulfonic acid moiety is preferably used in an amount corresponding to 2 to 16 molar percent of the aromatic dicarboxylic acid moiety in the copolyester (i).

When the copolyester (i) is mixed with the principal polyester component, it is preferable to prevent a distributional interaction between the copolyester (i) and the principal polyester component. If the distributional interaction occurs between the copolyester (i) and the principal polyester compound during the hollow filament-producing process, the size of the caves formed in the hollow filament becomes extremely small. When the distributional interaction has completely taken place, no cave is formed in the filament. Accordingly, it is preferable that the copolyester (i) be mixed with the principal polyester component in the following manner.

1. Pellets of the principal polyester component are mixed with pellets of the copolyester (i) and the mixed pellets are directly subjected to the melt-spinning process or the mixed pellets are melt-pelletized and the resultant pellets are subjected to the melt-spinning process.

2. When the polymerization of the principal polyester component is completed, the copolyester (i) is added to the resultant principal polyester compound in the state of a melt, or when the copolymerization of the copolyester (i) is completed, the principal polyester component is mixed with the copolyester (i) in the state of a melt. The mixture is directly subjected to the melt-spinning process or melt-pelletized and, then, subjected to the melt-spinning process.

3. The principal polyester component in the state of a melt is mixed with the copolyester (i) in the state of a melt by using a static mixer or an extruder, and the resultant mixture is directly subjected to the melt-spinning process or melt-pelletized and, then, subjected to the melt-spinning process.

The copolyester (i) is preferably used in an amount of 5 to 100 parts by weight per 100 parts by weight of the principal polyester component.

When the cave-forming agent consisting of the copolyester (i) is used, it is preferable that the removing procedure be carried out so that the copolyester (i) is removed in an amount of at least 10% by weight thereof from the hollow filaments.

The phosphorus compounds (ii) are of the formula (III):

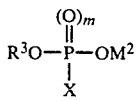

(III)

wherein $R^3$ represents a monovalent organic radical; X represents a member selected from the group consisting of $—OR^4$, wherein $R^4$ represents a hydrogen atom or a monovalentorganic radical, $—OM^3$, wherein $M^3$ represents a metal atom, and a monovalent organic radical; $M^2$ represents a metal atom, and; m represents zero or 1.

In the formula (III), the monovalent organic radicals represented by $R^3$, X and $R^4$ are respectively selected, independently from each other, from the group consisting of alkyl radicals having 1 to 30 carbon atoms, aryl radicals having 6 to 12 carbon atoms, alkylaryl radicals in which the alkyl group has 1 to 30 carbon atoms and the aryl group has 6 to 12 carbon atoms, arylalkyl radicals in which the aryl group has 6 to 12 carbon atoms and the alkyl group has 1 to 30 carbon atoms, and radicals of the formula $$-[(CH_2)_{l'}—O]_pR^5$$

wherein $R^5$ represents a member selected from the group consisting of a hydrogen atom, alkyl radicals having 1 to 30 carbon atoms and a phenyl radical, l' represents an integer of 2 or more and p represents an integer of 1 or more. Also, in the formula (III), it is preferable, that the metal atoms represented by $M^2$ and $M^3$ be respectively selected, independently from each other, from alkali metals, alkaline earth metals, $Mn_{\frac{1}{2}}$, $Co_{\frac{1}{2}}$ and $Zn_{\frac{1}{2}}$, more preferably, the group consisting of Li, Na, K, $Ca_{\frac{1}{2}}$ and $Mg_{\frac{1}{2}}$. The phosphorus compound (ii) may be selected from the group consisting of monomethylmonosodium phosphate, monoethyldisodium phosphate, monohydroxyethyldisodium phosphate, monophenyldisodium phosphate, monomethyldilithium phosphate, monomethyldipotassium phosphate, monomethyldisodium phosphate, dimethylmonosodium phosphate, monomethylmagnesium phosphate, monomethylmanganese phosphate, polyoxyethylenelaurylether calcium phosphate in which the polyoxyethylene group consists of addition-polymerized 5 molecules of ethylene oxide, polyoxyethylenelaurylether magnesium phosphate in which the polyoxyethylene group consists of addition polymerized 5 molecules of ethylene oxide, polyoxyethylenemethylether sodium phosphate in which the polyoxyethylene group consists of addition polymerized 50 molecules of ethylene oxide, monoethyl dipotassium phosphite, diphenylmonosodium phosphite, polyoxyethylenemethylether disodium phosphite, in which the polyoxyethylene group consists of addition polymerized 50 molecules of ethylene oxide, monomethylmonosodium phenylphosphonate, monomethylmonopotassium nonylbenzenephosphonate, and monomethylmonosodium phenylphosphinate. The above-mentioned phosphate compounds can be prepared in accordance with conventional methods. For example, monomethyldisodium phosphate and dimethylmonosodium phosphate, can be prepared by reacting trimethylphosphate with sodium acetate in ethyleneglycol medium. The formation of the phosphate compound may be carried out in a system in which a polyester is prepared. When the phosphorus compound (ii) is used as a cave-forming agent, it is preferable that the phosphorus compound (ii) be used in a molar amount corresponding to 0.3 to 15 percent, more preferably, 0.3 to 5%, of said acid moiety in said principal polyester component (a). In this case, it is also preferable that a portion of the hollow polyester filament that contains the cave-forming agent (b) consisting of the phosphorus compound (ii) be removed in an amount of from 2 to 50% by weight thereof by the removing operation (B).

The aromatic carboxy-sulfonic acid compounds (iii) are of the formula (IV):

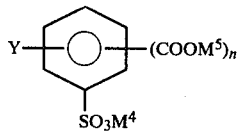

(IV)

wherein Y represents a member selected from the group consisting of a hydrogen atom and ester-forming organic radicals; $M^4$ represents a metal atom; $M^5$ represents a metal atom, and; n represents an integer of 1 or 2.

In the formula (IV), the ester-forming organic radical represented by Y is selected from the group consisting of radicals of the formula $—COOR^6$, wherein $R^6$ represents a member selected from the group consisting of a hydrogen atom, an alkyl radicals having 1 to 4 carbon atoms or a phenyl radical, and; radicals of the formula $$-CO[O-(CH_2)_{l''}]_{p'}OH$$

wherein l'' represents an integer of 2 or more and p' represents an integer of 1 or more. Also, in the formula (IV), it is preferable that the metal atoms represented by $M^4$ and $M^5$ be respectively selected, independently from each other, from the group consisting of alkali metals, alkaline earth metals, $Mn_{\frac{1}{2}}$, $Co_{\frac{1}{2}}$ and $Zn_{\frac{1}{2}}$, more preferably, from Li, Na, K, $Ca_{\frac{1}{2}}$ and $Mg_{\frac{1}{2}}$. Moreover, it is preferable that $M^4$ be selected from alkali metals, more preferably, from Na and K.

The aromatic carboxy-sulfonic acid compound (iii) may be selected from the group consisting of 3-carbomethoxy-sodium benzenesulfonate-5-carboxylic sodium salt, 3-carbomethoxy-sodium benzenesulfonate-5-carboxylic potassium salt, 3-carbomethoxy-potassium benzenesulfonate-5-carboxylic postassium salt, 3-hydroxyethoxycarbonyl-sodium benzenesulfonate-5-carboxylic sodium salt, 3-hydroxyethoxycarbonyl-sodium-benzenesulfonate-5-carboxylic magnesium salt, 3-carboxy-sodium benzenesulfonate-5-carboxylic sodium salt, sodium benzenesulfonate-3,5-dicarboxylic disodium salt and sodium benzenesulfonate-3,5-dicarboxylic monomagnesium salt. Preferably, the aromatic carboxy-sulfonic acid compound (iii) is used in a molar amount corresponding to 0.3 to 15 percent, more preferably, 0.3 to 5 percent, of the acid moiety in said principal polyester component (a). Also, a portion of the hollow filament containing the aromatic carboxy-sulfonic acid compound (iii) is preferably removed in an amount of from 2 to 50% by weight thereof by the removing operation (B).

The cave-forming agent consisting of phosphorus compound (ii) or the aromatic carboxy-sulfonic compound (iii) may be mixed with the principal polyester component in any stage before the melt-spinning process is completed. That is, the cave-forming agent may be mixed with the principal polyester pellets and the mixture may be subjected to the melt-spinning process. Also, the cave-forming agent may be added to a polymerization mixture for the principal polyester or to its polymerization product. In any manner of mixing, it is preferable that the cave-forming agent be mixed with the principal polyester in the state of a melt.

The hollow polyester filament is subjected to a treatment with an alkali aqueous solution. This alkali treatment causes not only at least a portion of the cave-forming agent present in the filament, but also a portion of the principal polyester component itself, to be removed therefrom, so as to form a number of caves through which the hollow can be connected to the outside of the filament. The alkali aqueous solution contains at least one alkaline compound selected from the group consisting of sodium hydroxide, potassium hydroxide, tetramethyl ammonium hydroxide, sodium carbonate and potassium carbonate. The preferable alkali is sodium hydroxide or potassium hydroxide. The concentration of the alkali in the aqueous solution is variable depending on the type of the alkali and the treating conditions. Usually, it is preferable that the alkali be contained in an amount of 0.01 to 40%, more preferably, from 0.1 to 30%, by weight in the alkali aqueous solution. Usually, the removing operation is preferably carried out at a temperature of from 20° to 100° C. for one minute to 4 hours. The treatment with the alkali aqueous solution is carried out so as to result in a decrease of 2 to 50% by weight of the hollow filament.

The hollow water-absorbing polyester filament of the present invention may be in the form of either a continuous filament or a staple fiber. Also, the filament may be in any form used in textile material, for example, multifilament yarn, spun yarn, woven fabric, knitted fabric or non-woven fabric. The multifilament yarn and the spun yarn may be a hard twist yarn or a soft twist yarn. Also, the multifilament yarn may be a textured yarn produced by a false-twisting method. When the textile material composed of the hollow water-absorbing polyester filaments of the present invention is a hard twist yarn having a twist coefficient of 10,000 or more, the hard twist yarn can be produced by first preparing core-in-sheath type composite filaments. In each of the filaments the sheath constituent consists of a blend of the principal polyester component and the cave-forming agent, and the core constituent consists of a polymeric material having a higher degree of alkali solubility than that of the sheath constituent. The hard twist yarn is produced by converting the core-in-sheath type composite filaments into a hard twist yarn and, then, by removing at least a portion of the cave-forming agent and the entire core constituent from the hard twist yarn by treating it with an alkali aqueous solution. The removing operation can be applied after the hard twist yarn is converted into a woven or knitted fabric.

When the textile material composed of the hollow water absorbing polyester filaments of the present invention, is a textured multifilament yarn produced by a false-twisting method, the textured yarn can be prepared by first preparing core-in-sheath type composite filaments. In each of the filaments the sheath constituent consists of a blend of the principal polyester component and the cave-forming agent, and the core constituent consists of the highly alkali soluble polymeric material. The textured yarn is produced by converting the core-in-sheath type composite filaments into a textured yarn by a false twisting method and, then, by removing at least a portion of the cave-forming agent and the entire core constituent from the textured yarn by treating it with an alkali aqueous solution. Before applying the removing operation, the textured yarn may be converted into a woven or knitted fabric.

The textile material may be a core-in-sheath type composite yarn in which the core constituent is composed of the hollow water-absorbing polyester filaments of the present invention and the sheath constituent is composed of extremely fine filaments, each having a denier of 0.9 or less. In this composite yarn, it is preferable that the proportion of the weight of the core constituent to the entire weight of the composite yarn is in a range of from 20 to 80%.

The textile material may be a mixed filament yarn composed of at least one type of the hollow water absorbing polyester filaments of the present invention, which are mainly located in an outer surface layer of the filament yarn, and at least one other type of polyester filaments. In this type of mixed filament yarn, the amount of the hollow water absorbing polyester filaments preferably corresponds to 20 to 90% of the entire weight of the mixed filament yarn.

The textile material may be a mixed fiber spun yarn composed of at least one type of the hollow water-absorbing polyester staple fibers of the present invention, which are mainly located in an outer surface layer of the spun yarn, and at least one other type of polyester staple fibers. In this type of mixed fiber spun yarn, it is preferable that the amount of the hollow water absorbing polyester staple fibers correspond to 20 to 90% of the entire weight of the spun yarn.

The textile material may be a bulky yarn fabric consisting of the hollow water absorbing polyester filaments which has spontaneously crimped.

The present invention will be further illustrated by the examples set forth below, which are provided for the purpose of illustration and should not be interpreted as in any way limiting the scope of the present invention. In the examples, all parts and percentages are indicated by weight unless otherwise noted.

In the examples, the water-absorbing rate of the hollow polyester filaments of the present invention and its durability were determined in accordance with the following method (JIS-L1018).

A knitted filament fabric having a weight of 50 to 200 g/m$^2$ was prepared from the hollow polyester filaments. 0.04 ml of water was dropped down from a location 1 cm above a horizontal surface of the knitted fabric to the horizontal surface and, then, allowed to penetrate into the knitted fabric. The time, in seconds, from the dropping of water to a stage at which the water completely penetrated into the knitted fabric such that no reflection of visible light from the water on the horizontal surface of the knitted fabric could be observed, was measured. The water-absorbing rate of the filaments was expressed in terms of the measured time, i.e., seconds per 0.04 ml of water.

The durability of the water-absorbing rate of the hollow polyester filaments was determined by comparing the water-absorbing rate of the hollow polyester filaments which had not yet been laundered with the rate of those which had been laundered in an aqueous solution of 0.3% by weight of a detergent consisting of an anionic soapless soap (Zab, a trademark, made by Kao Soap, Japan) at a temperature of 40° C. for 30 minutes, by using a home electric washing machine. The laundering operation was carried out once or for a desired number of times, for example, once or ten times.

The percentage of water absorption of the hollow polyester filaments was determined by using the following method. A mass of hollow polyester filaments, for example, knitted or woven fabric, was completely dried at room temperature for 24 hours and the dry weight ($W_1$) of the mass was measured. The dry filament mass was immersed in water at room temperature for at least 30 minutes. The water-wetted filament mass was centrifuged by using a centrifuge with a rotatable cylindrical basket having a diameter of 17 cm at a revolution rate of 1730 r.p.m. for 5 minutes. The weight ($W_2$) of the centrifuged filament mass was measured. The percentage of water absorption of the filament mass was calculated in accordance with the equation:

$$\text{Water absorption (\%)} = \frac{W_2 - W_1}{W_1} \times 100$$

The decrease in weight of the hollow polyester filaments caused by the alkali treatment was determined by using the following method. A mass of hollow polyester filaments was completely dried at a temperature of 110° C. for at least 60 minutes, and the dry weight ($W_1$) of the filament mass was measured. The dried filament mass was subjected to an alkali treatment, washed thoroughly with water, and centrifuged at the same revolution rate as that mentioned above for 5 minutes. The alkali treated filament mass was completely dried by using the same method as described above. The dry weight ($W_3$) of the alkali treated filament mass was measured. The decrease in weight was calculated in accordance with the equation:

$$\text{Decrease (\%)} = \frac{W_1 - W_3}{W_1} \times 100$$

The decrease in tensile strength of the hollow polyester filaments caused by the alkali treatment was determined in accordance with the equation:

$$\text{Decrease (\%)} = \frac{S_1 - S_2}{S_1} \times 100$$

wherein $S_1$ represents an average tensile strength of 20 non-alkali treated filaments and $S_2$ denotes an average tensile strength of 20 alkali treated filaments.

The degree of fibrillation of the hollow polyester filaments was determined by the following fibrillation test. A plane woven fabric was produced from a hollow water absorbing filament yarn having a yarn count of 75 denier/24 filaments. The fabric had a density of 30 warps/cm×36 wefts/cm. An area of 5 cm$^2$ of the fabric was rubbed 200 times with a polyester filament crape fabric under a load of 500 g. The rubbed surface of the fabric was observed after the rubbing operation was completed. The number of fibrillated yarns in the fabric was counted. The degree of the fibrillation was calculated in accordance with the equation:

$$\text{Degree of fibrillation (\%)} = (X/Y) \times 100$$

wherein X denotes the number of fibrillated yarns in the rubbed area of the fabric, and Y denotes the total sum of the warps and the wefts in the rubbed area of the fabric.

EXAMPLE 1

A glass flask having a rectification column was charged with a copolymerization mixture consisting of 297 parts of dimethylterephthalate, 265 parts of ethylene glycol, 53 parts (corresponding to 11.7 molar % of the dimethylterephthalate) of sodium 3,5-di(carbomethoxy) benzene sulfonate, 0.084 part of manganese acetate tetrahydrate and 1.22 part of sodium acetate trihydrate. The copolymerization mixture was subjected to an ester interchange process. After a theoretical amount of methyl alcohol was distilled from the copolymerization mixture, the reaction product was placed in a condensation polymerization flask having a rectification column, and then, mixed with 0.090 parts of a stabilizer consisting of a 56% normal phosphoric acid aqueous solution and 0.135 part of antimony trioxide as a polymerization catalyst. The mixture was subjected to a copolymerization process at a temperature of 275° C. under an ambient pressure for 20 minutes, under a reduced pressure of 30 mmHg for 15 minutes, and then, under a high vacuum for 100 minutes. The final pressure was 0.38 mmHg. The resultant copolyester exhibited an intrinsic viscosity of 0.405 and a softening point of 200° C. The copolyester was pelletized by an ordinary pelletizing process.

15 parts by weight of the copolyester pellets were mixed with 85 parts by weight of polyethylene terephthalate pellets by using a mixer for 5 minutes. The mixture was dried in a nitrogen gas stream at a temperature of 110° C. for two hours and, then, at a temperature of 150° C. for seven hours. The dried mixture was melted and extruded at a temperature of 290° C. by using a bi-axial screw type extruder to pelletize it. The pelletized mixture exhibited an intrinsic viscosity of 0.520 and a softening point of 262° C.

The mixture pellets were dried by an ordinary method and, then, subjected to a conventional melt-spinning process wherein each of the spinning orifices had two arc-shaped openings which in combination formed a circle but were separate from each other. The arc-shaped openings had a width of 0.05 mm and the circle had a diameter of 0.6 mm. An undrawn hollow polyester multifilament yarn having a yarn count of 300 denier/24 filaments was obtained. In each individual filament, the ratio of the outside diameter of the filament to the diameter of the hollow was 2:1 and the ratio of the cross-sectional area of the hollow to entire cross-sectional area of the filament including the hollow (hollow ratio) was 25%.

The undrawn filament yarn was drawn at a draw ratio of 4.1 by using a conventional drawing apparatus. The resultant drawn filament yarn had a yarn count of 71 denier/24 filaments.

The multifilament yarn was converted into a knitted fabric. The knitted fabric was scoured and, then, dried in accordance with conventional methods.

The dried knitted fabric was treated with an aqueous solution of 1.0% of sodium hydroxide, at the boiling temperature thereof, for two hours, so as to form numerous fine caves evenly distributed in each individual filament. The decrease in weight of the fabric caused by the alkali treatment was 15%.

FIG. 2 is an electron microscope view of the peripheral surface of an individual filament in the alkali-treated knitted fabric at a magnification of 3,000.

The total sum of the opening area of the outside concaves corresponded to 18% of the entire peripheral surface of the filament. The lateral sizes of the outside concaves were in a range of from 0.1 to 1 microns and the longitudinal size of the outside concaves were in a range of from 1 to 6 microns.

The alkali-treated fabric exhibited a water-absorbing rate and a percentage of water absorption as indicated in Table 1. Also, the decrease in tensile strength of the fabric due to the alkali treatment was as indicated in Table 1.

As a result of the fibrillation test, the degree of fibrillation of the fabric was 7%.

EXAMPLE 2

The same procedure as those described in Example 1 were carried out, except that the copolyester pellets and the polyethylene terepthalate pellets were used in amounts of 10 parts and 90 parts by weight, respectively, and the alkali treatment was carried out for 2.5 hours. The properties of the resultant fabric are indicated in Table 1. The fibrillation test being applied to the fabric resulted in the degree of fibrillation being 7%. The outside concaves formed in the peripheral surface of the resultant hollow filaments had a lateral size in a range of from 0.1 to 1 microns and a longitudinal size in a range of from 1 to 8 microns.

EXAMPLE 3

The same copolymerization procedures as those described in Example 1 were carried out, except that sodium 3,5-di(carbomethoxy) benzene sulfonate was used in an amount of 11.8 parts by weight (corresponding to 2.6 molar % of dimethylterephthalate) and ethylene glycol was used in an amount of 195 parts by weight. The resultant copolyester exhibited an intrinsic viscosity of 0.490 and a softening point of 258° C.

The same melt-spinning procedures as those described in Example 1 were carried out, except that a mixture of 50 parts by weight of the above-mentioned copolyester and 50 parts by weight of polyethylene terephthalate having an intrinsic viscosity of 0.640 was converted to a hollow polyester multifilament yarn having a yarn count of 73 denier/24 filaments. The hollow ratio of the individual filaments was 25%.

The yarn was converted into a knitted fabric. The fabric was scoured and dried by conventional methods, and then, treated with an 1% sodium hydroxide aqueous solution, at the boiling temperature thereof, for four hours. The decrease in weight of the fabric was 16%. The properties of the fabric are indicated in Table 1. As a result of the fibrillation test, the degree of fibrillation of the fabric was 6%. The outside concaves formed in the peripheral surface of the resultant hollow filaments had a lateral size in a range of from 0.1 to 0.6 microns and a longitudinal size in a range of from 0.1 to 1 microns.

COMPARISON EXAMPLE 1

The same procedures as those described in Example 1 were carried out, except that no alkali treatment was applied to the knitted fabric. The properties of the fabric are indicated in Table 1.

COMPARISON EXAMPLE 2

The same knitted fabric as that prepared in Example 2 was treated with water, at a temperature of 130° C., for four hours, by using an autoclave. The properties of the resultant fabric are indicated in Table 1.

COMPARISON EXAMPLE 3

The same water treatment as that mentioned in Comparison Example 2 was applied to the same knitted fabric as that mentioned Example 3. The results are indicated in Table 1.

COMPARISON EXAMPLE 4

The same procedures as those described in Example 1 were carried out, except that the hollow filament yarn was produced from the copolyester alone, and the alkali treatment was carried out by using a 0.5% sodium hydroxide aqueous solution, at the boiling point thereof, for 60 minutes. The decrease in weight of the fabric caused by the alkali treatment was 15%. The results are indicated in Table 1.

COMPARISON EXAMPLE 5

A glass flask having a rectification column was charged with 197 parts by weight of dimethyl terephthalate, 124 parts of ethylene glycol, and 0.118 parts of calcium acetate monohydrate. The mixture of the above-mentioned compound was subjected to an ester interchange process in accordance with conventional procedures. A theoretical amount of methyl alcohol was distilled from the reaction mixture. Thereafter, the reaction product was placed into a polymerization flask having a rectification column. 0.112 part of trimethyl phosphate as a stabilizing agent and 0.079 part of antimony oxide as a polymerization catalyst were added to the reaction product. The mixture was subjected to a polymerization process at a temperature of 280° C., under an ambient pressure, for 30 minutes, and then, under a reduced pressure of 30 mmHg for 15 minutes. Thereafter, the pressure of the polymerization system was allowed to return to the ambient pressure, and 10 parts of a mixture of sodium alkylsulfonates, wherein the alkyl groups had 8 to 20 carbon atoms and wherein an average number of the carbon atoms in the alkyl groups was about 14, were added to the polymerization mixture. Next, the polymerization mixture was subjected to an additional reaction process for 80 minutes in which the polymerization pressure was gradually reduced to a final pressure of 0.32 mmHg while continuously stirring the mixture.

The resultant polyester had an intrinsic viscosity of 0.622. The polyester was pelletized and dried by using a conventional pelletizer and dryer.

The resultant polyester pellets were subjected to the same melt-spinning and drawing processes as those described in Example 1. A hollow polyester multifilament yarn having a yarn count of 71 denier/24 filaments was obtained.

The yarn was converted into a knitted fabric. The fabric was treated with a 0.5% sodium hydroxide aqueous solution at the boiling temperature thereof for 60 minutes. The decrease in weight of the fabric was 12%.

FIG. 1 is an electron microscope view of the peripheral surface of an individual filament in the alkali-treated fabric at a magnification of 3,000. As a result of the fibrillation test, the degree of fibrillation of the fabric was 15%. The properties of the fabric are indicated in Table 1.

The lateral and longitudinal size of the concaves formed in the peripheral surfaces of the alkali-treated filaments were in ranges of from 0.1 to 0.4 and 20 microns or more, respectively.

column. 0.112 part of trimethyl phosphate as a stabilizing agent and 0.079 part of antimony oxide as a polymerization catalyst were added to the reaction product. The mixture was subjected to a polymerization process at a temperature of 280° C., under an ambient pressure, for 20 minutes, under a reduced pressure of 30 mmHg for 15 minutes, and under a high vacuum for 80 minutes. The final pressure of the high vacuum was 0.38 mmHg.

The resultant polyester and cave-forming agent blend exhibited an intrinsic viscosity of 0.600 and a softening point of 258° C. The blend was pelletized and dried by using a conventional pelletizer and dryer. The dried blend was subjected to the same melt-spinning and drawing processes as those described in Example 1.

By the same procedures as those described in Example 1, the resultant hollow polyester multifilament yarn was converted into a knitted fabric, and the fabric was alkali treated with a 1.0% sodium hydroxide aqueous solution, at the boiling point thereof, for 120 minutes. The results are indicated in Table 2.

As a result of the fibrillation test, the degree of fibrillation of the fabric was 5%.

Figure 3A:
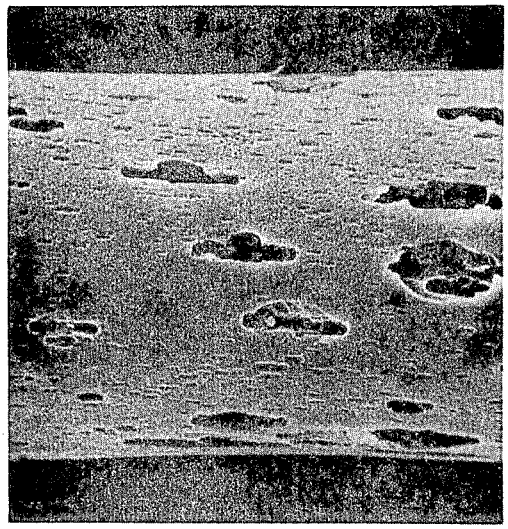

FIG. 3A is an electron microscope view of the peripheral surface of an individual filament in the alkali-treated knitted fabric at a magnification of 3,000.

Figure 3B:
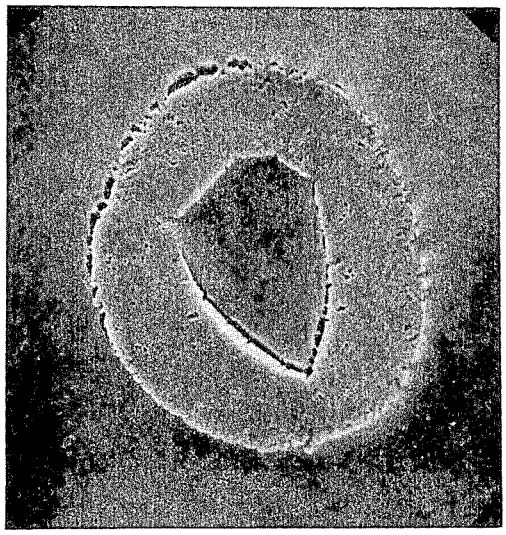
FIG. 3B is an electron microscope view of a cross-sectional profile of the hollow water-absorbing polyester filament indicated in FIG. 3A at a magnification of 3000.

FIG. 3B is an electron microscope view of the cross-sectional profile of a filament in the alkali-treated knitted fabric at a magnification of 3,000.

The lateral size and the longitudinal size of the outside concaves in the peripheral surface were in the ranges of from 0.1 to 3 microns and from 0.4 to 9 microns, respectively.

EXAMPLE 5

The same procedures as those described in Example 4 were carried out, except that instead of the sodium

TABLE 1

| Item Example No. | Alkali treatment: Concentration of NaOH (%) | Alkali treatment: Treating time (min.) | Alkali treatment: Decrease in weight (%) | Alkali treatment: Decrease in tensile strength (%) | Product: Water absorbing rate (sec.) Defore laundering | Product: Water absorbing rate (sec.) After one laundering | Product: Water absorbing rate (sec.) After ten launderings | Product: Water absorption (%) |
|---|---|---|---|---|---|---|---|---|
| Example 1 | 1 | 120 | 15 | 26.2 | 2 | 3 | 3 | 80 |
| Example 2 | 1 | 150 | 15 | 24.1 | 2 | 4 | 5 | 79 |
| Example 3 | 1 | 240 | 16 | 25.2 | 2 | 10 | 12 | 78 |
| Comparison Example 1 | — | 0 | 0 | — | 7 | 230 | 600< | 38 |
| Comparison Example 2 | 0 | 240 | 0.2 | — | 10 | 270 | 600< | 36 |
| Comparison Example 3 | 0 | 240 | 0.2 | — | 15 | 450 | 600< | 35 |
| Comparison Example 4 | 0.5 | 60 | 15 | — | 8 | 360 | 600< | 34 |
| Comparison Example 5 | 0.5 | 60 | 12 | 40.5 | 2 | 3 | 3 | 80 |

EXAMPLE 4

A glass flask having a rectification column was charged with 197 parts by weight of dimethyl terephthalate, 124 parts of ethylene glycol, 4 parts (corresponding to 1.3 molar % of the dimethylterephthalate) of sodium 3-carbomethoxybenzene-sulfonate-5-sodium carboxylate and 0.118 parts of calcium acetate monohydrate. The mixture of the above-mentioned compound was subjected to an ester interchange process in accordance with conventional procedures. A theoretical amount of methyl alcohol was distilled from the reaction mixture. Thereafter, the reaction product was placed into a polymerization flask having a rectification 3-carbomethoxybenzene sulfonate-5-sodium carboxylate, 2 parts by weight (corresponding to 0.62 molar % of the dimethylterephthalate used) of sodium 3-carbomethoxybenzene sulfonate-5-potossium carboxylate were used. The resultant blend of the polyester and the cave-forming agent exhibited an intrinsic viscosity of 0.597 and a softening point of 257° C. As a result of the fibrillation test, the degree of fibrillation was 5%. The properties of the alkali-treated fabric are indicated in Table 2.

The outside concaves formed in the peripheral surface of the resultant hollow filaments had a lateral size in a range of from 0.1 to 2 microns and a longitudinal size in a range of from 0.3 to 9 microns.

EXAMPLE 6

The same procedures as those described in Example 4 were carried out, except that 10 parts by weight (corresponding to 3.25 molar % of the dimethylterephthalate used) of sodium 3-carbomethoxybenzenesulfonate-5-sodium carboxylate were added to the polymerization system after the ester interchange reaction was completed. The resultant blend of the polyester with the cave-forming agent exhibited a intrinsic viscosity of 0.602 and a softening point of 256° C.

As a result of the fibrillation test, the degree of fibrillation of the fabric was 5%.

The properties of the alkali treated fabric are indicated in Table 2.

The outside concaves formed in the peripheral surface of the resultant hollow filaments had a lateral size in a range of from 0.1 to 2.5 microns and a longitudinal size in a range of from 0.3 to 14 microns.

EXAMPLE 7

Procedures identical to those described in Example 6 were carried out, except that 4 parts by weight (corresponding to 1.18 molar % of the dimethylterephthalate used) of sodium 3-hydroxyethoxycarbonylbenzene sulfonate-5-sodium carboxylate were used in place of the sodium 3-carbomethoxybenzenesulfonate-5-sodium carboxylate. The resultant blend of the polyester and the cave-forming agent exhibited an intrinsic viscosity of 0.603 and a softening agent of 259° C. As a result of the fibrillation test, the degree of fibrillation of the fabric was 5%. Properties of the alkali treated fabric are indicated in Table 2.

The outside concaves formed in the peripheral surface of the resultant hollow filaments had a lateral size in a range of from 0.1 to 2 microns and a longitudinal size in a range of from 0.3 to 9 microns.

EXAMPLE 8

A mixture of 100 parts by weight of polyethylene terephthalate pellets having an intrinsic viscosity of 0.655 and 2 parts by weight of sodium 2-carboxybenzenesulfonate-5-sodium carboxylate powder was prepared by using a mixer for 5 minutes, and dried at a temperature of 110° C. for two hours and, then, at a temperature of 150° C. for seven hours. The dried mixture was pelletized by using a bi-axial screw type extruder at a temperature of 290° C. The resultant blend of the polyester and the cave-forming agent exhibited an intrinsic viscosity of 0..542 and a softening point of 262° C. After the fibrillation test, the degree of fibrillation was 5%.

Properties of the alkali treated fabric are indicated in Table 2.

The outside concaves formed in the peripheral surface of the resultant hollow filaments had a lateral size in a range of from 0.1 to 3 microns and a longitudinal size in a range of from 0.3 to 10 microns.

TABLE 2

| Item Example No. | Alkali treatment: Concentration of NaOH (%) | Alkali treatment: Treating time (min.) | Alkali treatment: Decrease in weight (%) | Alkali treatment: Decrease in tensile strength (%) | Product: Water absorbing rate (sec.) Defore laundering | Product: Water absorbing rate (sec.) After one laundering | Product: Water absorbing rate (sec.) After ten launderings | Product: Water absorption (%) |
|---|---|---|---|---|---|---|---|---|
| Example 4 | 1 | 120 | 15 | 18.7 | 2 | 3 | 3 | 79 |
| Example 5 | 1 | 210 | 14 | 17.2 | 3 | 4 | 4 | 77 |
| Example 6 | 0.5 | 120 | 17 | 21.5 | 1 | 2 | 3 | 82 |
| Example 7 | 1 | 120 | 16 | 19.5 | 2 | 3 | 4 | 80 |
| Example 8 | 1 | 120 | 15 | 18.9 | 2 | 3 | 3 | 78 |

EXAMPLE 9

A glass flask having a rectification column was charged with 197 parts by weight of dimethyl terephtalate, 124 parts of ethylene glycol, and 0.118 parts of calcium acetate monohydrate. The mixture of the above-mentioned compound was subjected to an ester interchange process in accordance with conventional procedures. A theoretical amount of methyl alcohol was distilled from the reaction mixture. Thereafter, the reaction product was placed into a polymerization flask having a rectification column. 0.112 part of trimethyl phosphate as a stabilizing agent, 0.079 part of antimony oxide as a polymerization catalyst and 1.1 parts (corresponding to 0.7 molar % of dimethylterephthalate used) of monomethyl disodium phosphate were added to the reaction product. The mixture was subjected to a polymerization process at a temperature of 280° C., under an ambient pressure, for 20 minutes, under a reduced pressure of 30 mmHg for 15 minutes, and then, under a high vacuum for 80 minutes while reducing the pressure to a final value of 0.35 mmHg.

The resultant blend of a polyester and a cave-forming agent exhibited an inrinsic viscosity of 0.636 and a softening point of 260° C. The blend was pelletized and dried by using a conventional pelletizer and dryer. The dried blend was subjected to the same melt-spinning and drawing processes as those described in Example 1.

By the same procedures as those described in Example 1, the resultant hollow polyester multifilament yarn having a yarn count of 71 denier/24 filaments was converted into a knitted fabric, and the fabric was alkali treated with a 1.0% sodium hydroxide aqueous solution at the boiling point thereof for 180 minutes. The results are indicated in Table 3.

As a result of the fibrillation test, the degree of fibrillation of the fabric was 3%.

Figure 4:
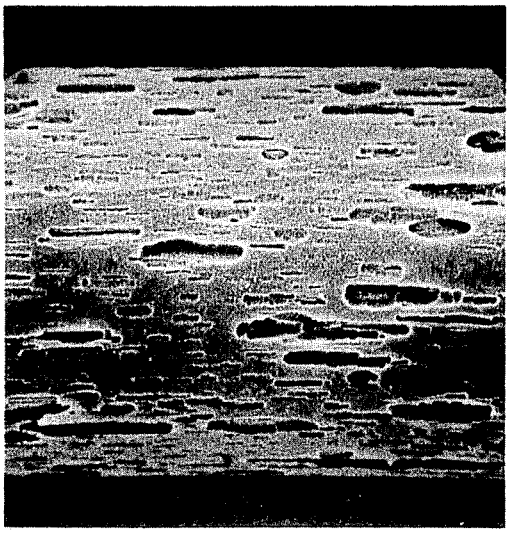

FIG. 4 is an electron microscope view of the peripheral surface of an individual filament in the alkali-treated knitted fabric at a magnification of 3,000.

The lateral size and the longitudinal size of the outside concaves in the peripheral surface were in the ranges of 0.1 to 1.2 microns and from 0.1 to 10 microns, respectively.

EXAMPLE 10

The same procedures as those described in Example 9 were carried out, except that instead of the monomethyldisodium phosphate, 0.95 parts by weight (corresponding to 0.7 molar % of the dimethylterephthalate used) of monomethyl magnesium phosphate were used. The resultant blend of the polyester and the cave-forming agent exhibited an intrinsic viscosity of 0.622 and a softening point of 257° C.

As a result of the fibrillation test, the degree of fibrillation of the fabric was 3%.

The properties of the alkali-treated fabric are indicated in Table 3.

The outside concaves formed in the peripheral surface of the resultant hollow filaments had a lateral size in a range of from 0.1 to 0.5 microns and a longitudinal size in a range of from 0.1 to 5 microns.

EXAMPLE 11

The same procedures as those described in Example 9 were carried out, except that 2 parts of potassium polyoxyethylenelaurylether phosphate, in which the polyoxyethylene group consisted of five ethylene oxide molecules addition-polymerized, were used in place of monomethyl disodium phosphate. The resultant blend of the polyester with the cave-forming agent exhibited an intrinsic viscosity of 0.584 and a softening point of 260° C.

As a result of the fibrillation test, the degree of fibrillation of the fabric was found to be 5%.

The properties of the alkali treated fabric are indicated in Table 3.

The outside concaves formed in the peripheral surface of the resultant hollow filaments had a lateral size in a range of from 0.1 to 1 microns and a longitudinal size in a range of from 0.1 to 10 microns.

EXAMPLE 12

Procedures identical to those described in Example 9 were carried out, except that 2 parts of magnesium polyoxyethylenelaurylether phosphate, in which the polyoxyethylene group consisted of five ethylene oxide molecules addition polymerized, were used in place the monomethyl disodium phosphate. The resultant blend of the polyester and the cave-forming agent exhibited an intrinsic viscosity of 0.636 and a softening point of 257° C. As a result of the fibrillation test, the degree of fibrillation of the fabric was 5%.

Properties of the alkali treated fabric are indicated in Table 3.

The outside concaves formed in the peripheral surface of the resultant hollow filaments had a lateral size in a range of from 0.1 to 0.5 microns and a longitudinal size in a range of from 0.1 to 10 microns.

EXAMPLE 13

Procedures identical to those described in Example 9 were carried out, except that 4 parts of monoethylmonosodium phenylphosphate were used in place of monomethyldisodium phosphate.

The resultant blend of the polyester and the cave-forming agent exhibited an intrinsic viscosity of and a softening point of 258° C. After the fibrillation test, the degree of fibrillation was found to be 5%.

Properties of the alkali treated fabric are indicated in Table 3.

The outside concaves formed in the peripheral surface of the resultant hollow filaments had a lateral size in a range of from 0.1 to 1.5 microns and a longitudinal size in a range of from 0.1 to 10 microns.

EXAMPLE 14

Procedures identical to those described in Example 9 were carried out, except that 2 parts of diphenyl monosodium phosphite were used instead of the monomethyldisodium phosphate.

The resultant blend of the polyester and the cave-forming agent exhibited an intrinsic viscosity of 0.628 and a softening point of 260° C. After the fibrillation test, the degree of fibrillation of the fabric was found to be 5%.

Properties of the alkali treated fabric are indicated in Table 3.

The outside concaves formed in the peripheral surface of the resultant hollow filaments had a lateral size in a range of from 0.1 to 1 microns and a longitudinal size in a range of from 0.1 to 8 microns.

COMPARISON EXAMPLE 6

A glass flask having a rectification column was charged with 197 parts by weight of dimethyl terephthalate, 124 parts of ethylene glycol, 1.2 parts of methyl benzoylbenzoate as an anti-gelatinizing agent and 0.118 parts of calcium acetate monohydrate. The mixture of the above-mentioned compound was subjected to an ester interchange process in accordance with conventional procedures. A theoretical amount of methyl alcohol was distilled from the reaction mixture. Thereafter, the reaction product was placed into a polymerization flask having a rectification column. 1.42 parts (corresponding to 1 molar % of the dimethyl terephthalate used) of trimethyl phosphate as a stabilizing agent and 0.079 part of antimony oxide as a polymerization catalyst were added to the reaction product. The mixture was subjected to a polymerization process at a temperature of 280° C., under an ambient pressure, for 20 minutes, and then, under a reduced pressure of 30 mmHg for 15 minutes.

Next, the polymerization mixture was subjected to an additional reaction process for 80 minutes in which the pressure of the polymerization pressure was gradually reduced into a final pressure of 0.38 mmHg while continuously stirring the mixture.

The resultant polyester had an intrinsic viscosity number of 0.540 and a softening point of 255° C. The polyester was pelletized and dried by using a conventional pelletizer and dryer.

The dried polyester pellete were subjected to the same procedures as those mentioned in Example 9. As a result of the fibrillation test, the degree of fibrillation was 2%.

Properties of the alkali-treated fabric are indicated in Table 3.

TABLE 3

| | Alkali treatment | | | | Product | | | |
|---|---|---|---|---|---|---|---|---|
| | | | | | Water absorbing rate (sec.) | | | |
| Item Example No. | Concentration of NaOH (%) | Treating time (min.) | Decrease in weight (%) | Decrease in tensile strength (%) | Defore laundering | After one laundering | After ten launderings | Water absorption (%) |
| Example 9 | 1 | 180 | 21 | 25.8 | 2 | 3 | 4 | 78 |
| Example 10 | 1 | 180 | 20 | 24.3 | 2 | 4 | 4 | 79 |
| Example 11 | 1 | 120 | 22 | 27.5 | 2 | 2 | 3 | 80 |

TABLE 3-continued

| Item Example No. | Alkali treatment: Concentration of NaOH (%) | Treating time (min.) | Decrease in weight (%) | Decrease in tensile strength (%) | Product: Water absorbing rate (sec.) Defore laundering | After one laundering | After ten launderings | Water absorption (%) |
|---|---|---|---|---|---|---|---|---|
| Example 12 | 1 | 120 | 20 | 26.5 | 1 | 2 | 2 | 78 |
| Example 13 | 1 | 90 | 20 | 23.1 | 1 | 2 | 3 | 82 |
| Example 14 | 1 | 120 | 20 | 23.4 | 2 | 4 | 3 | 80 |
| Comparison Example 6 | 1 | 240 | 20 | 26.2 | 8 | 600< | 600< | 35 |

COMPARISON EXAMPLE 7

The same procedures as those described in Example 9 were carried out, except that 4 parts by weight (corresponding to 1.03 molar % of the dimethyl terephthalate used) of sodium phosphate were used instead of the monomethyl disodium phosphate. The resultant polymer pelletes exhibited an intrinsic viscosity of 0.653 and contained sodium phosphate crystals in the form of large grains, each having a size of 5 microns or more. When the polymer pellets were subjected to the same melt-spinning process as that described in Example 1, it was found that the pressure of the melt in the extruder rapidly increased and, therefore, it was impossible to continue the spinning operation.

EXAMPLE 15

The same procedures as those described in Example 6 were carried out, except that instead of the sodium 3-carbomethoxybenzene sulfonate-5-sodium carboxylate, 4 parts by weight (corresponding to 1.22 molar % of the dimethylterephthalate used) of sodium 3-hydroxyethoxycarbonyl benzene sulfonate-5-Mg carboxylate were used. The resultant blend of the polyester and the cave-forming agent exhibited an intrinsic viscosity of 0.645 and a softening point of 259° C. The alkali treatment was carried out under the conditions as indicated in Table 4. As a result of the fibrillation test, the degree of fibrillation was 4%.

The properties of the alkali-treated fabric are indicated in Table 4.

The outside concaves formed in the peripheral surface of the resultant hollow filaments had a lateral size in a range of from 0.1 to 3 microns and a longitudinal size in a range of from 0.5 to 8 microns.

EXAMPLE 16

Procedures identical to those described in Example 6 were carried out, except that 1 part by weight (corresponding to 0.3 molar % of the dimethylterephthalate used) of sodium benzenesulfonate-3,5-di-sodium di-carboxylate were used in place of the sodium 3-carbomethoxybenzenesulfonate-5-sodium carboxylate. The resultant blend of the polyester and the cave-forming agent exhibited an intrinsic viscosity of 0.647 and a softening point of 261° C. The alkali treatment was carried out under the conditions as indicated in Table 4. After the fibrillation test, the degree of fibrillation was found to be 4%.

Properties of the alkali treated fabric are indicated in Table 4.

The outside concaves formed in the peripheral surface of the resultant hollow filaments had a lateral size in a range of from 0.5 to 3 microns and a longitudinal size in a range of 0.5 to 10 microns.

TABLE 4

| Item Example No. | Alkali treatment: Concentration of NaOH (%) | Treating time (min.) | Decrease in weight (%) | Decrease in tensile strength (%) | Product: Water absorbing rate (sec.) Defore laundering | After one laundering | After ten launderings | Water absorption (%) |
|---|---|---|---|---|---|---|---|---|
| Example 15 | 1 | 150 | 20 | 25.1 | 1 | 2 | 2 | 82 |
| Example 16 | 1 | 240 | 20 | 23.7 | 2 | 3 | 3 | 81 |

EXAMPLE 17

A glass flask having a rectification column was charged with 100 parts of dimethyl terephthalate, 60 parts of ethylene glycol and 0.06 parts of calcium acetate monohydrate. The mixture of the above-mentioned compound was subjected to an ester interchange process in which the mixture was heated from 140° to 230° C. over a period of 4 hours in a nitrogen gas atmosphere. A theoretical amount of methyl alcohol was distilled from the reaction mixture. Thereafter, the reaction product was placed into a polymerization flask having a rectification column. 0.06 part of trimethyl phosphate as a stabilizing agent, 0.04 part of antimony oxide as a polymerization catalyst, 4 parts of a 25% sodium 3-hydroxyethoxycarbonyl benzenesulfonate-5-sodium carboxylate solution in ethylene glycol and 1.5 parts of a 20% titanium dioxide slurry in ethylene glycol were added to the reaction product. The mixture was subjected to a polymerization process in which the pressure of the polymerization system was reduced from 760 to 1 mmHg over a period of one hour, and the temperature was raised from 230° C. to 280° C. over a period of 1.5 hours. Thereafter, the polymerization system was heated at a temperature of 280° C. for 3 hours. The resultant polyester had an intrinsic viscosity of 0.640 and a softening point of 260° C. The polyester was pelletized and dried by using a conventional pelletizer and dryer. This polyester is referred to as polymer A.

Separately, a glass flask having a rectification column was charged with a polymerization mixture consisting of 100 parts of dimethylterephthalate, 70 parts of ethylene glycol, 11.4 parts (7.5 molar %) of sodium 3,5-di(-carbomethoxy)benzene sulfonate, 0.03 parts of manganese acetate tetrahydrate and 0.3 parts of sodium acetate trihydrate. The polymerization mixture was subjected to an ester interchange process in which the temperature of the mixture was raised from 140° C. to 230° C. over a period of 4 hours. After a theoretical amount of methyl alcohol was distilled from the polymerization mixture, the reaction product was placed in a polymerization flask having a rectification column and then mixed with 0.03 parts of a 56% normal phosphoric acid aqueous solution and 0.04 part of antimony trioxide as a polymerization catalyst. The mixture was subjected to a polymerization process in which the pressure of the polymerization system was reduced from 760 to 1 mmHg over a period of one hour, the temperature of the system was raised from 230° C. to 280° C. over a period of 1.5 hours and, finally, the polymerization mixture was heated at a temperature of 280° C. under a reduced pressure of 1 mmHg for 30 minutes.

The resultant copolyester (which will be referred to as polymer B hereinafter) had an intrinsic viscosity of 0.439 and a softening point of 246° C.

The polymers A and B were subjected to a core-in-sheath type composite filament melt spinning process at a temperature of 290° C. In the composite filament, the sheath constituent consisted of the polymer A and the core constituent consisted of polymer B. The ratio in weight of the polymer A to the polymer B was 80:20. The resultant undrawn multifilament yarn was drawn at a draw ratio of 4 in accordance with a conventional drawing method. The resultant composite filament yarn had a yarn count of 75 denier/24 filaments. The polymers A and B exhibited alkali dissolving rate constants of $3.1\times10^{-8}$ and $290\times10^{-8}$ cm/sec., respectively.

A portion of the composite filament yarn was S twisted at 2500 turns/m and the remaining portion of the yarn was Z twisted at 2500 turns/m. The resultant two types of hard twist yarns were twist-set by using steam, at a temperature of 80° C., for 30 minutes.

A precursory geogette crepe weave having a warp density of 47 yarns/cm and a weft density of 32 yarns/cm was produced from the S twist yarn and Z twist yarn which were arranged alternately. The precursory geogette crepe weave was relaxed by using a rotary washer in boiling water for 20 minutes to convert the precursory weave to a crepe weave. The crepe weave was set in accordance with a usual method and, then, treated with a 3.5% sodium hydroxide aqueous solution, at the boiling point thereof, for 60 minutes, to remove the cave-forming agent and the polymer B from the filaments in the crape weave. The core-in-sheath type composite filaments in the crape weave were converted into hollow water-absorbing filaments having a number of caves formed therein.

After the hollow filament crepe weave was subjected to the fibrillation test, the degree of fibrillation was found to be 5%.

The properties of the crepe weave are indicated in Table 5.

The outside concaves formed in the peripheral surface of the resultant hollow filaments had a lateral size in a range of from 0.1 to 2 microns and a longitudinal size in a range of from 0.3 to 9 microns.

EXAMPLE 18

The same procedures as those described in Example 17 were carried out, except that one part of disodium monomethyl phosphate was used is place of the sodium 3-hydroxyethoxycarboxyl benzenesulfonate-5-sodium carboxylate used in the preparation of the polymer A. The resultant polymer C exhibited an intrinsic viscosity of 0.554, a softening point of 259° C. and an alkaline dissolving rate constant of $3.9\times10^{-8}$ cm/sec. After the fibrillation test, the degree of fibrillation was found to be 4%.

Properties of the alkali-treated crepe weave are indicated in Table 5.

The outside concaves formed in the peripheral surface of the resultant hollow filaments had a lateral size in a range of from 0.1 to 1.5 microns and a longitudinal size in a range of from 0.1 to 15 microns.

EXAMPLE 19

The same procedures as those for producing the polymer B described in Example 17 were carried out, except that sodium 3,5-di(carbomethoxy)benzenesulfonate was used in an amount of 17.8 parts, which corresponded to 11.7 molar % of the dimethyl terephthalate used. The resultant copolyester exhibited an intrinsic viscosity of 0.405 and a softening point of 200° C.

A mixture of 15 parts by weight of the copolyester and 85 parts of a polyethylene terephthalate having an intrinsic viscosity of 0.710 was prepared by using a mixer for 5 minutes, dried at a temperature of 110° C. for 2 hours and, then, at a temperature of 150° C. for 5 hours, and, after that, pelletized at a temperature of 275° C. by using a bi-axial screw type extruder. The pelletized mixture exhibited an intrinsic viscosity of 0.620, an alkali dissolving rate constant of $3.4\times10^{-8}$ cm/sec., and a softening point of 262° C. This mixture will be referred to as polymer D hereinafter.

Separately, the same procedures as that for producing the polymer A described in Example 17, were carried out, except that the ester interchange reaction product was mixed with 0.06 parts of trimethyl phosphate and 0.04 parts of antimony trioxide, the mixture was placed in a polymerization vessel, the pressure of the polymerization system was reduced from 760 mmHg to 1 mmHg over a period of one hour, while raising the temperature of the polymerization system from 230° C. to 280° C., and when the pressure of the polymerization system reached 1 mmHg, 5 parts of polyoxyethylene glycol having an average molecular weight of 20,000 and 3 parts of mixed sodium alkylsulfonate in which the alkyl group contained an average number of carbon atoms of 14 were added to the polymerization mixture, and the admixture was heated at a temperature of 280° C. for 3 hours. The resultant polymer mixture exhibited an intrinsic viscosity of 0.625, a softening point of 262° C. and an alkali dissolving rate constant of $55\times10^{-8}$ cm/sec., and will be referred to as polymer E hereinafter.

The same procedures for producing a core-in-sheath type composite filament yarn as those described in Example 17 were carried out, except that the sheath constituent consisted of the polymer D, the core constituent consisted of the polymer E and the ratio in weight of the core constituent to the sheath constituent was 25:75.

The same twisting procedures, weaving procedures and alkali treating procedures as those described in Example 17 were carried out, except that the above-mentioned core-in-sheath type composite filament yarn was used.

After the fibrillation test, the degree of fibrillation was found to be 7%.

Properties of the crape weave are indicated in Table 5.

The outside concaves formed in the peripheral surface of the resultant hollow filaments had a lateral size in a range of from 0.1 to 1 microns and a longitudinal size in a range of from 1 to 6 microns.

COMPARISON EXAMPLE 8

The same procedures as those described in Example 17 were carried out, except that no alkali treatment was applied to the precursory crepe weave.

Properties of the crepe weave are indicated in Table 5.

TABLE 5

| Item Example No. | Alkali treatment: Concentration of NaOH (%) | Treating time (min.) | Decrease in weight (%) | Decrease in tensile strength (%) | Product: Water absorbing rate (sec.) Defore laundering | After one laundering | After ten launderings | Water absorption (%) |
|---|---|---|---|---|---|---|---|---|
| Example 17 | 3.5 | 60 | 37 | 22.1 | 1 | 1 | 2 | 60 |
| Example 18 | 3.5 | 45 | 37 | 23.4 | 1 | 2 | 3 | 62 |
| Example 19 | 1.0 | 240 | 43 | 23.5 | 1 | 1 | 2 | 66 |
| Comparison Example 8 | — | — | 0 | — | 1 | 600< | 600< | 23 |

EXAMPLE 20

The same procedures for producing a core-in-sheath type composite filament yarn as those described in Example 17 were carried out. The composite filament yarn was textured by a false twisting method at a false twist number of 3330 turns/m, a heater temperature of 210° C. and a processing speed of 118 m/min. The textured yarn was converted into a plane weave having a warp density of 31 yarns/cm and a weft density of 30 yarns/cm. The plane weave was refluxed in boiling water by using a liquid flow type dyeing machine for 20 minutes, pre-set in accordance with the usual method and, then, treated with a 3.5% sodium hydroxide aqueous solution at a boiling point thereof for 60 minutes.

The outside concaves formed in the peripheral surface of the resultant hollow filaments had a lateral size in a range of from 0.1 to 2 microns and a longitudinal size in a range of from 0.3 to 9 microns.

The fibrillation test applied to the plane weave resulted in a 4% degree of fibrillation. The properties of the plane weave are indicated in Table 6.

EXAMPLE 21

The same procedures as those described in Example 20 were carried out, except that one part of disodium monomethyl phosphate was used in place of the sodium 3-hydroxyethoxycarbonyl benzenesulfonate-5-sodium carboxylate used in the preparation of the polymer A. The resultant polymer C exhibited an intrinsic viscosity of 0.554, a softening point 257° C. and an alkali dissolving rate constant of $3.9\times10^{-8}$ cm/sec.

The fibrillation test resulted in a 3% degree of fibrillation on the textured yarn plane weave.

The outside concaves formed in the peripheral surface of the resultant hollow filaments had a lateral size in a range of from 0.1 to 1.5 microns and a longitudinal size in a range of from 0.1 to 15 microns.

Properties of the alkali-treated textured yarn plane weave are indicated in Table 6.

EXAMPLE 22

The same procedures for producing a core-in-sheath type composite filament yarn as those described in Example 19 were carried out.

The composite filament yarn was textured, woven and alkali treated in the same manner as that described in Example 20.

The outside concaves formed in the peripheral surface of the resultant hollow filaments had a lateral size in a range of from 0.1 to 1 microns and a longitudinal size in a range of from 1 to 6 microns. The fibrillation test applied to the plane weave resulted in a 7% of degree of fibrillation. The properties of the textured yarn plane weave are indicated in Table 6.

COMPARISON EXAMPLE 9

The same procedures as those described in Example 20 were carried out, except that no alkali treatment was applied to the textured yarn plane weave.

Properties of the plane weave are indicated in Table 6.

TABLE 6

| Item Example No. | Alkali treatment: Concentration of NaOH (%) | Treating time (min.) | Decrease in weight (%) | Decrease in tensile strength (%) | Product: Water absorbing rate (sec.) Defore laundering | After one laundering | After ten launderings | Water absorption (%) |
|---|---|---|---|---|---|---|---|---|
| Example 20 | 3.5 | 60 | 40 | 24.8 | 1 | 2 | 3 | 113 |
| Example 21 | 3.5 | 45 | 39 | 26.2 | 1 | 1 | 2 | 109 |
| Example 22 | 1.0 | 240 | 41 | 25.7 | 1 | 2 | 3 | 115 |
| Comparison Example 9 | — | — | 0 | — | 1 | 600< | 600< | 61 |

EXAMPLE 23

An ester interchange reaction vessel was charged with 100 parts of dimethyl terephthalate, 60 parts of ethylene glycol, 0.06 parts of calcium acetate monohydrate and 1.94 parts of sodium acetate trihydrate. The mixture of the above-mentioned compounds was subjected to an ester exchange process by heating it at from 140° to 230° C., over a period of 4 hours, in a nitrogen atmosphere, while allowing the resulting methyl alcohol to be distilled off from the reaction mixture. In order to provide a polymerization system, the reaction product was mixed with 1.06 parts of trimethyl phosphate, 0.04 parts of antimony oxide and 1.5 parts of a 20% titanium dioxide slurry in ethylene glycol, and the mixture was placed in a polymerization vessel. The mixture was subjected to a polymerization process in which the pressure of the polymerization system was reduced from 760 mmHg to 1 mmHg over a period of one hour, and the temperature was raised from 230° C. to 290° C. over a period of 1.5 hours. Thereafter, the polymerization system was heated at a temperature of 290° C., under a pressure of 1 mmHg, for three hours. The resultant polyester contained about 1% by weight of methylsodium phosphate and exhibited an intrinsic viscosity of 0.630, and a softening point of 259° C. The polymer was pelletized and dried by using a conventional pelletizer and dryer. With respect to the 1.06 parts of trimethyl phosphate, 0.06 parts thereof was utilized as a stabilizing agent and the remaining portion thereof was converted into the methylsodium phosphate.

The resultant polyester pellets were subjected to the same melt-spinning and drawing process as that described in Example 1, except that the undrawn hollow polyester multifilament yarn had a yarn count of 330 denier/24 filaments, the draw ratio was 4.5 and the resultant drawn yarn had a yarn count of 73 denier/24 filaments.

The multifilament yarn was converted into a knitted fabric. The fabric was scoured and, then, dried in accordance with conventional methods. The dried knitted fabric was treated with an aqueous solution of sodium hydroxide in a concentration and for a period of time as indicated in Table 7. The decrease in weight of the fabric caused by the alkali treatment is also indicated in Table 7. The alkali-treated fabric exhibited a water-absorbing rate, a percentage of water absorption and a decrease in tensile strength as indicated in Table 7.

After the fibrillation test, no fibrillation was found on the rubbed fabric surface.

EXAMPLE 24

A glass flask having a rectification column was charged with a copolymerization mixture consisting of 297 parts of dimethylterephthalate, 195 parts of ethylene glycol, 11.8 parts (corresponding to 2.6 molar % of the dimethylterephthalate) of sodium 3,5-di(carbomethoxy) benzene sulfonate, 0.084 part of manganese acetate tetrahydrate and 1.22 part of sodium acetate trihydrate. The copolymerization mixture was subjected to an ester interchange process. After a theoretical amount of methyl alcohol was distilled from the copolymerization mixture, the reaction product was placed in a condensation polymerization flask having a rectification column, and then, mixed with 0.090 parts of a stabilizer consisting of a 56% normal phosphoric acid aqueous solution, 0.135 part of antimony trioxide as a polymerization catalyst and 3 parts (corresponding to 1.25 molar % of the dimethylterephthalate) of monomethyl disodium phosphate. The mixture was subjected to a copolymerization process at a temperature of 275° C. under an ambient pressure for 20 minutes, under a reduced pressure of 30 mmHg for 15 minutes, and then, under a high vacuum for 100 minutes. The final pressure was 0.38 mmHg. The resultant polyester exhibited an intrinsic viscosity of 0.490 and a softening point of 257° C. The polyester was pelletized and dried by using a conventional pelletizer and dryer. The dried blend was subjected to the same melt-spinning and drawing processes as those described in Example 1.

By the same procedures as those described in Example 1, the resultant hollow polyester multifilament yarn having a yarn count of 71 denier/24 filaments was converted into a knitted fabric, and the fabric was alkali treated with a 0.5% sodium hydroxide aqueous solution at the boiling point thereof for 100 minutes. The results are indicated in Table 7.

After the fibrillation test, the degree of fibrillation of the fabric was 7%. As a result of electron microscopic observation of the alkali treated filament, it was found that the lateral size and the longitudinal size of the outside concaves in the peripheral surface of the filament were in the ranges of from 0.1 to 3 microns and from 0.3 to 10 microns, respectively.

TABLE 7

| | Alkali treatment | | | | Product | | | |
|---|---|---|---|---|---|---|---|---|
| | | | | | Water absorbing rate (sec.) | | | |
| Item Example No. | Concentration of NaOH (%) | Treating time (min.) | Decrease in weight (%) | Decrease in tensile strength (%) | Defore laundering | After one laundering | After ten launderings | Water absorption (%) |
| Example 23 | 1 | 180 | 20 | 25.0 | 1 | 2 | 2 | 79 |
| Example 24 | 0.5 | 100 | 20 | 28.0 | 1 | 1 | 2 | 80 |

We claim:

1. A hollow water-absorbing polyester filament having at least one hollow extending in parallel to the longitudinal axis of said filament, and a number of caves distributed in at least a portion of the body of said filament and consisting of a number of fine outside concaves formed in the peripheral surface of said filament, a number of fine pores formed within the body of said filament, a number of fine inside concaves formed in the hollow surface of said filament, and a number of fine channels through which said pores are connected to each other, and to said outside concaves and inside concaves, said outside and inside concaves and said pores extending approximately in parallel to the longitudinal axis of said filament, which filament has been prepared by the process comprising the steps of:

(A) preparing hollow polyester filaments each having at least one hollow extending in parallel to the longitudinal axis of said filament, from a blend of (a) a principal polyester component which comprises an acid moiety comprising at least one aromatic dicarboxylic acid or its ester-forming derivative and a glycol moiety comprising at least one alkylene glycol having 2 to 6 carbon atoms or its ester-forming derivative, with (b) a cave-forming agent, and (B) removing at least a portion of said cave-forming agent and a portion of said principle polyester component from said resultant hollow polyester filaments by treating them with an alkali aqueous solution, said cave-forming agent comprising at least one member selected from the group consisting of (i) copolyester which comprises a glycol compound moiety, an aromatic dicarboxylic acid compound moiety and an additional divalent organic sulfonic acid compound moiety of the formula (II):

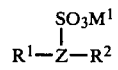

(II)

wherein Z represents a member selected from the group consisting of trivalent aromatic hydrocarbon radicals and trivalent aliphatic hydrocarbon radicals, $M^1$ represents a member selected from the group consisting of hydrogen and metal atoms; $R^1$ represents an ester-forming organic radical and $R^2$ represents a member selected from the group consisting of a hydrogen atom and ester-forming organic radicals;

(ii) phosphorus compounds of the formula (III):

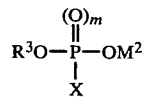

(III)

wherein $R^3$ represents a monovalent organic radical; X represents a member selected from the group consisting of $—OR^4$, wherein $R^4$ represents a hydrogen atom or a monovalent organic radical, $—OM^3$, wherein $M^3$ represents a metal atom, and a monovalent organic radical; $M^2$ represents a metal atom and; m represents zero or 1; and (iii) aromatic carboxy-sulfonic acid compounds of the formula (IV):

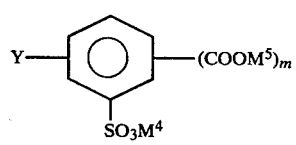

(IV)

wherein Y represents a member selected from the group consisting of a hydrogen atom and ester-forming organic radicals, $M^4$ represents a metal atom, $M^5$ represents a metal atom, and n represents an integer of 1 or 2.

2. A hollow water-absorbing polyester filament as claimed in claim 1, wherein the longitudinal size of each of said outside and inside concaves and said pores corresponds to 20 times or less the lateral size thereof.

3. A hollow water-absorbing polyester filament as claimed in claim 1, wherein said hollow filament consist essentially of a polyester having at least 90% by a molar amount of recurring units of the formula (I):

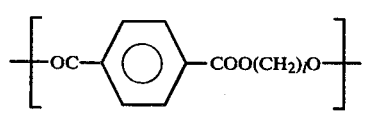

(I)

wherein l represents an integer of 2 to 6.

4. A hollow water-absorbing polyester filament as claimed in claim 1, wherein a single hollow is located in the center portion of said filament.

5. A hollow water-absorbing polyester filament as claimed in claim 3, wherein said polyester is a polyethylene terephthalate.

6. A hollow water-absorbing polyester filament as claimed in claim 3, wherein said polyester is a polybutylene terephthalate.

7. A hollow water-absorbing polyester filament as claimed in claim 1, wherein the entire cross-sectional area of said hollow in said filament corresponds to 10 to 30% of the entire cross-sectional area of said filament including said hollow.

8. A hollow water-absorbing polyester filament as claimed in claim 1, wherein the total sum of the cross-sectional areas of said outside and inside concaves and pores corresponds to 5 to 30% of the cross-sectional area of said filament excluding said hollow.

9. A hollow water-absorbing polyester filament as claimed in claim 1, wherein said filament has a denier of 10 or less (a dtex of 11.1 or less).

10. A hollow water-absorbing polyester filament as claimed in claim 1, wherein the tensile strength of said filament is 2.0 g/d or more.

11. A hollow water-absorbing polyester filament as claimed in claim 1, wherein said filament has a water-absorbing rate of at least 120 seconds per 0.04 ml of water.

12. A hollow water-absorbing polyester filament as claimed in claim 1, wherein said filament has an absorption percentage of at least 50%.

13. A hollow water-absorbing polyester filament as claimed in claim 1, wherein said filament exhibits a degree to fibrillation of 10% or less.

14. A hollow water-absorbing polyester filament as claimed in claim 1, wherein the total sum of the opening areas of said outside concaves correspond to 2 to 50% of the entire peripheral surface area of said filament.

15. A textile material containing a number of hollow water-absorbing polyester filaments as claimed in claim 1.

16. A hollow water-absorbing polyester filament as claimed in claim 1, wherein each of said outside and inside concaves and said pores has a longitudinal size of at the largest 50 times the lateral size thereof, which is in a range of from 0.01 to 3 microns.

17. A hollow water-absorbing polyester filament as claimed in claim 1, wherein said additional divalent organic sulfonic acid moiety in said copolyester (i) is used in an amount corresponding to 2 to 16 molar percent of said aromatic dicarboxylic acid moiety.

18. A hollow water-absorbing polyester filament as claimed in claim 1, wherein said copolyester (i) is used in an amount of 5 to 100 parts by weight per 100 parts by weight of said principal polyester component.

19. A hollow water-absorbing polyester filament as claimed in claim 1, wherein said additional divalent organic sulfonic acid moiety of the formula (II) is selected from the group consisting of sodium and potassium 3,5-di(carbomethoxy)benzene sulfonates.

20. A hollow water-absorbing polyester filament as claimed in claim 1, wherein said cave-forming agent (b) consisting of said copolyester (i) is removed in an amount of at least 10% by weight thereof from said hollow filaments by said removing operation (B).

21. A hollow water-absorbing polyester filament as claimed in claim 1, wherein said cave-forming agent (b) consists of at least one said phosphorus compound (ii) and is used in a molar amount corresponding to 0.3% to 15% of said acid moiety in said principal polyester component (a).

22. A hollow water-absorbing polyester filament as claimed in claim 1, wherein a portion of said hollow filament containing said cave-forming agent (b) comprising said phosphorus compound of the formula (III) is removed in an amount of from 2% to 50% by weight thereof by said removing operation (B).

23. A hollow water-absorbing polyester filament as claimed in claim 1, wherein said phosphorus compound of the formula (III) is selected from the group consisting of monomethyldisodium phosphate, dimethylmonosodium phosphate, monomethylmonosodium phosphate, monoethyldisodium phosphate, monohydroxethyldisodium phosphate, monophenyldisodium phosphate, monomethyldilithium phosphate, and monomethyldipotassium phosphate.

24. A hollow water-absorbing polyester filament as claimed in claim 1, wherein said cave-forming agent (b) comprises said aromatic carboxy-sulfonic acid compound of the formula (IV) and is used in a molar amount corresponding to 0.3% of 15% of said acid moiety in said principal polyester component (a).

25. A hollow water-absorbing polyester filament as claimed in claim 1, wherein a portion of said hollow filament containing said cave-forming agent (b) comprising said aromatic carboxy-sulfonic acid compound of the formula (IV) is removed in an amount of from 2% to 50% by weight thereof by said removing operation (B).

26. A hollow water-absorbing polyester filament as claimed in claim 1, wherein said aromatic carboxy-sulfonic acid compound of the formula (II) is selected from the group consisting of 3-carbomethoxy-sodium benzensulfonate-5-carboxylic sodium salt, 3-carbomethoxy-sodium benzenesulfonate-5-carboxylic potassium salt, 3-carbomethoxy-potassium benzenesulfonate-5-carboxylic potassium salt, 3-hydroxyethoxycarbonyl-sodium benzenesulfonate-5-carboxylic sodium salt, 3-hydroxyethoxycarbonyl-sodium benzenesulfonate-5-carboxylicmagnesium salt, 3-carboxy-sodium benzenesulfonate-5-carboxylic sodium salt, sodium benzenesulfonate-3,5-dicarboxylic disodium salt, and sodium benzenesulfonate-3,5-dicarboxylic monomagnesium salt.

27. A hollow water-absorbing polyester filament as claimed in claim 1, wherein said alkali aqueous solution contains at least one alkaline compound selected from the group consisting of sodium hydroxide, potassium hydroxide, tetramethylammonium hydroxide, sodium carbonate, and potassium carbonate.

28. A hollow water-absorbing polyester filament as claimed in claim 1, wherein said treatment with said alkali aqueous solution results in a decrease of 2% to 50% in the weight of said filaments.

* * * * *

UNITED STATES PATENT AND TRADEMARK OFFICE

CERTIFICATE OF CORRECTION

PATENT NO. : 4,361,617

DATED : November 30, 1982

INVENTOR(S) : T. Suzuki, et al.

It is certified that error appears in the above-identified patent and that said Letters Patent is hereby corrected as shown below:

ABSTRACT:

2nd Column, 10th line from bottom: "the" should be cancelled

Column 30, line 59: "principle" should be --principal--

Column 6, line 12: "doil" should be --diol--

Column 7, line 3: "principle" should be --principal--
line 12: "napthalene" should be --naphthalene--

Column 22, line 54: "pellete" should be --pellets--

Column 23, line 19: "pelletes" should be --pellets--

UNITED STATES PATENT AND TRADEMARK OFFICE

CERTIFICATE OF CORRECTION

PATENT NO. : 4,361,617

DATED : November 30, 1982

INVENTOR(S) : T. Suzuki, et al.

It is certified that error appears in the above-identified patent and that said Letters Patent is hereby corrected as shown below:

Column 25, line 48: "crape" should be --crepe--

Column 26, line 65: "crape" should be --crepe--

Signed and Sealed this

*Eighteenth* Day of *October 1983*

[SEAL]

*Attest:*

GERALD J. MOSSINGHOFF

*Attesting Officer*

*Commissioner of Patents and Trademarks*